US006762689B2

(12) United States Patent
Dechape

(10) Patent No.: US 6,762,689 B2
(45) Date of Patent: Jul. 13, 2004

(54) UNIVERSAL TRAFFIC SIGNAL DISPLAY SYSTEM AND APPARATUS, AND METHOD OF USING THE SAME

(76) Inventor: Michel L. Dechape, 1709 E. Lake Dr., Novi, MI (US) 48377

( * ) Notice: Subject to any disclaimer, the term of this patent is extended or adjusted under 35 U.S.C. 154(b) by 0 days.

(21) Appl. No.: 10/254,415

(22) Filed: Sep. 25, 2002

(65) Prior Publication Data

US 2003/0095052 A1 May 22, 2003

Related U.S. Application Data

(60) Provisional application No. 60/333,286, filed on Nov. 16, 2001.

(51) Int. Cl.[7] ..... G08B 5/22

(52) U.S. Cl. ..... 340/815.45; 340/907; 340/332; 340/331; 340/815.65; 340/815.69; 40/541; 40/550; 40/557; 116/63

(58) Field of Search ..... 340/815.48, 907, 340/332, 331, 81.65, 815.69; 40/541, 550, 557; 116/63

(56) References Cited

U.S. PATENT DOCUMENTS 4,929,936 A 5/1990 Friedman et al.
5,136,287 A 8/1992 Borenstein
5,612,794 A 3/1997 Brandestini et al.
5,633,629 A 5/1997 Hochstein
5,936,599 A 8/1999 Reymond
6,054,932 A * 4/2000 Gartner et al. ..... 340/815.65
6,072,407 A 6/2000 Shin
6,283,613 B1 9/2001 Schaffer
6,489,937 B1 * 12/2002 Ruvinsky ..... 345/46

* cited by examiner

*Primary Examiner*—Daryl Pope
(74) *Attorney, Agent, or Firm*—Carrier, Blackman & Associates, P.C.; William D. Blackman; Joseph P. Carrier

(57) ABSTRACT

A traffic signal display apparatus includes a display surface having a plurality of bicolor bipolar LEDs thereon in an array. When current is fed into the LEDs in a first direction, the bicolor bipolar LEDs display a first color, which may be green. When current is fed in the opposite direction, the bicolor bipolar LEDs display a second color, which may be red. When current is fed into the array alternately in both directions, the bicolor bipolar LEDs display a third color, which may be yellow. The display apparatus may be subdivided into multiple independent zones, allowing arrows to be displayed. The single display apparatus can therefore be used to replace the three to five stacked conventional traffic light display units.

17 Claims, 6 Drawing Sheets

UNIVERSAL TRAFFIC SIGNAL DISPLAY SYSTEM AND APPARATUS, AND METHOD OF USING THE SAME

CROSS-REFERENCE TO RELATED APPLICATIONS

The present application claims filing date priority under 35 U.S.C. 119(e) from U.S. provisional application No. 60/333,286, filed Nov. 16, 2001.

BACKGROUND OF THE INVENTION

1. Field of the Invention

The present invention relates to traffic signal display devices, to systems including such devices, and to methods of generating signals using those devices. More particularly, in a first embodiment thereof, the present invention relates to a unitary traffic signal display apparatus which is able to change the display thereof, and which is thereby able to display any of the controlled sequence of selected signals. The apparatus hereof is capable of modifying its display either by changing color, or by changing the display to any one of a plurality of other signals, depending on the electronic input to the apparatus.

2. Description of the Background Art

Traffic signal lamps, to give signals to drivers on the road, have conventionally used a separate individual lamp for each color to be displayed. Most standard traffic signal devices in use today have three lamps, one each for green, yellow and red. When turning arrows are added, it is not uncommon for a signal device to include four or more different lamps in the assembly. By way of example, one conventional traffic signal assembly might include a green lamp, an amber lamp, a red lamp, an amber turning arrow, and a green turning arrow.

This conventional arrangement is large and cumbersome, may require strong wires to hold it suspended due to its weight, and may consume a lot of power to operate.

A number of different devices are brown for providing traffic signalling devices which incorporate light emitting diodes (LEDs). Examples of some of the known devices include U.S. Pat. No. 5,136,287 to Borenstein U.S. Pat. No. 5,633,629 to Hochstein, U.S. Pat. No. 5,936,599 to Reymond, U.S. Pat. No. 6,054,932 to Gartner et al., and U.S. Pat. No. 6,283,613 to Schaffer.

Although the known devices have some utility for their intended purposes, a need still exists in the art for an improved traffic signal display apparatus. In particular, there is a need for an improved traffic signal display apparatus, in which a single, compact display unit is selectively operable to display any of the current signals and directional arrows in any of the three standard colors.

SUMMARY OF THE INVENTION

The present invention provides an improved traffic signal display apparatus, in which a single, compact display unit is selectively operable to display a sequence of colored signals. The display apparatus hereof is able to send out any one of a plurality of different output displays, depending on the selected input signal.

A traffic signal display apparatus according to a first embodiment of the invention includes a circuit board or other substrate. The LEDs are arranged in a selected grouping on the substrate, to form predetermined shapes or symbols.

Optionally, the bicolor bopolar LEDs may be grouped into two or more zones or patterns, which may each be independently powered, as desired, to form one or more of a plurality of symbols.

The traffic signal display apparatus may also include a circuit for selectively routing electricity to the zones.

When electricity is fed into the array via the first input pathway, the bicolor bipolar LEDs display a first color, which may be green. When electricity is fed into the array via the second input pathway, the bicolor bipolar LEDs display a second color, which may be red. When electricity is fed into the array via both of the first and second input pathways, the bicolor bipolar LEDs effectively display a third color, which may be amber.

The second embodiment thereof, the present invention relates to a traffic signal display system including the display apparatus and a controller for controlling the operation of the apparatus.

Using the system of the present invention, the controller operates the traffic signal display apparatus by powering the inputs thereto. The system and apparatus according to the present invention allows a single display unit to sequentially display the three commonly used traffic colors, i.e., green, amber and red. In addition, the same unit can be selectively powered to display a left arrow in any of the above colors, a right arrow in any of the above colors, or a combination of a straight arrow and either a left or right tarn arrow.

In an example of one possible alternative visual display, an apparatus according to a second embodiment of the invention may be made to display a pedestrian crossing symbol, or a "Don't Walk" symbol. Other types of symbols may also be made according to the present invention. Again, any one of these alternative symbols can be made in a variety of colors, and can be made either solid or flying.

Any of the displays possible with the apparatus of the present invention may be made to be steadily illuminated, or alternatively, may be made to show a flashing display by interrupting the current flow thereto.

The present invention also relates to a method of generating a sequence of traffic signals, using the described apparatus.

Accordingly, it is an object of the present invention to provide a method and apparatus for generating a series of traffic signals over time.

It is another object of the present invention to provide a method and apparatus for generating a sequence of colored signals from a single traffic signal display apparatus, by sending different signals thereto.

It is a further object of the present invention to provide a traffic signal display system including a display apparatus and a controller for operating same.

It is yet another object of the present invention to provide a single traffic signal display apparatus capable of generating any one of a plurality of different visual outputs, by selectively powering inputs thereto.

For a more complete understanding of the present invention, the reader is referred to the following detailed description, which should be read in conjunction with the accompanying drawings. Throughout the following detailed description and in the drawings, like numbers refer to like parts.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

DETAILED DESCRIPTION OF THE PREFERRED EMBODIMENT

Figure 3:
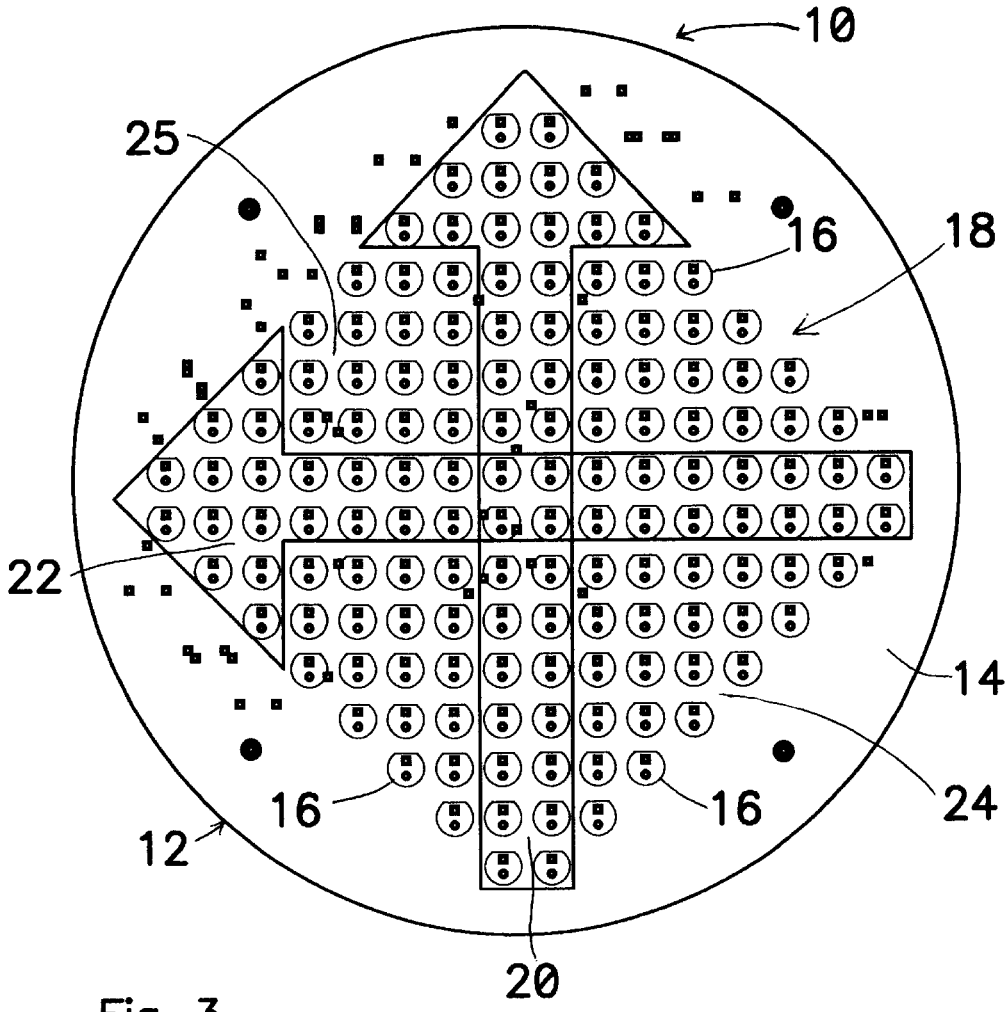
FIG. 3 is a front plan view of a signal display board in accordance with a first embodiment of the present invention, having a plurality of bicolor bipolar LEDs affixed thereto.

Referring now to the drawings, a traffic signal display apparatus, in accordance with a first embodiment of the present invention, is shown at 10 in FIG. 3.

The apparatus 10 includes a circuit board 12 having an outwardly facing display surface 14 with a plurality of bicolor bipolar light-emitting diodes (LEDs) 16 affixed thereto to form an array 18. Bicolor bipolar LEDs are commercially available. As used herein, the term "array" is intended to mean an arrangement or grouping of LEDs.

Figure 1:
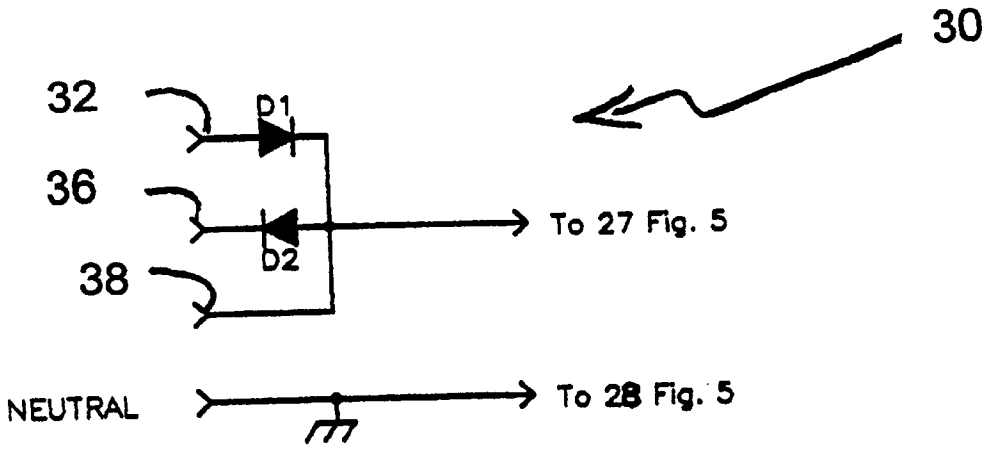
FIG. 1 is a partial circuit diagram showing a first circuit for operating a signal display apparatus according to the present invention using input from a conventional traffic control device.
Figure 2:
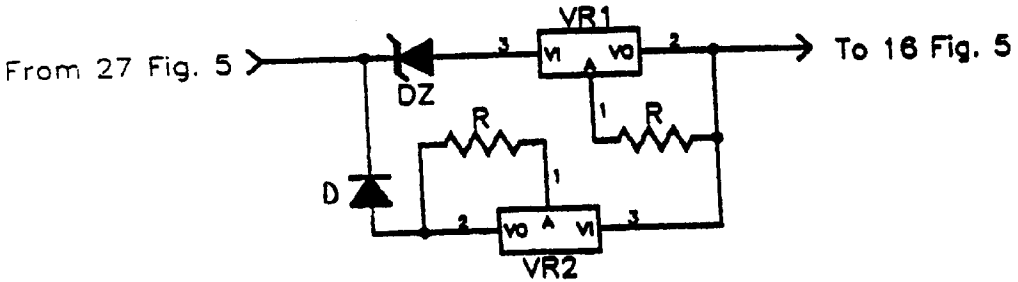
FIG. 2 is a partial circuit diagram showing an optional bipolar current regulator, which is usable in connection with the present invention.

The apparatus 10 also includes a circuit such as that shown at 30 in FIG. 1, or another circuit to interconnect the LEDs, such as that shown on the board 12.

In a preferred embodiment of the invention, the LEDs 16 are arranged and interconnected on the circuit board 12 in selected zones or patterns to form one or more predetermined shapes and/or symbols. The LEDs may be grouped into two or more zones or patterns, such as those shown at 20, 22, 24 and 25. Each of the zones or patterns 20, 22, 24, 25 may be independently powered by the standard 115 or 120 volts A.C. supplied by existing traffic controllers, using the circuit 30 of FIG. 1.

Figure 4:
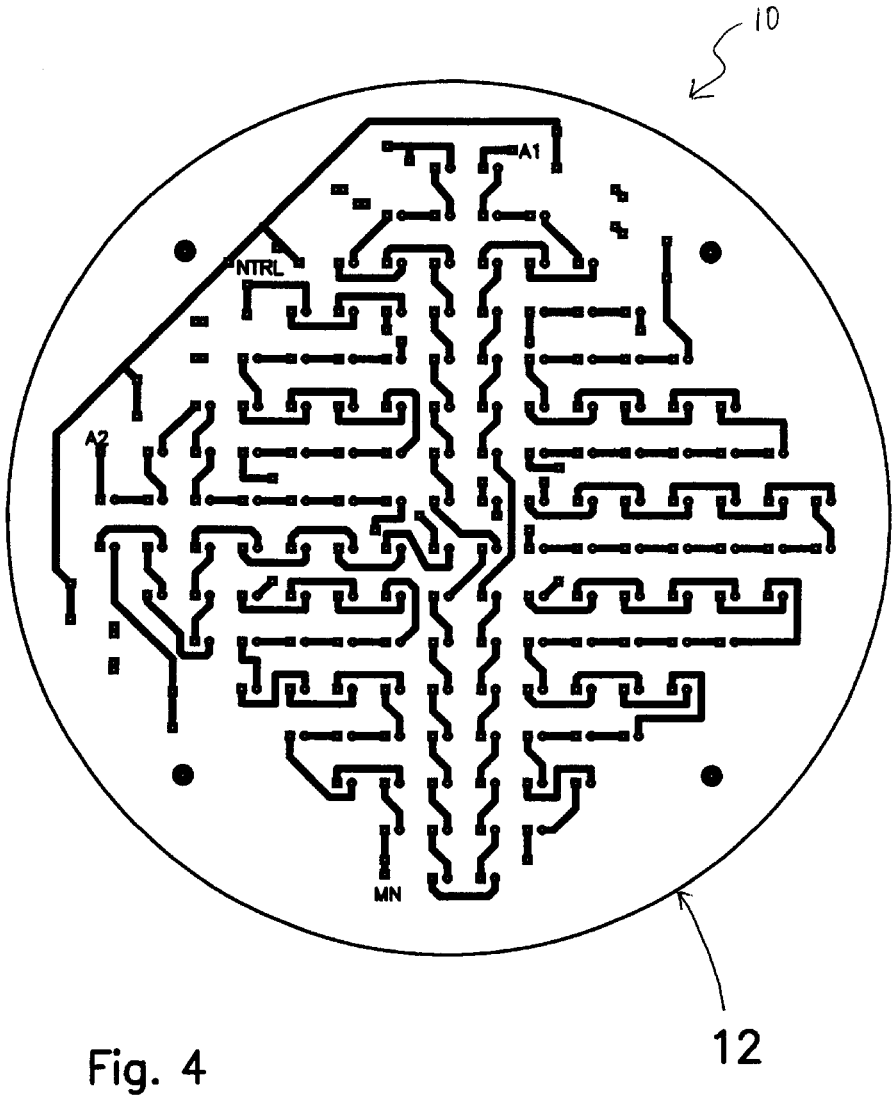
FIG. 4 is a rear plan view of the display board of FIG. 3.
Figure 5:
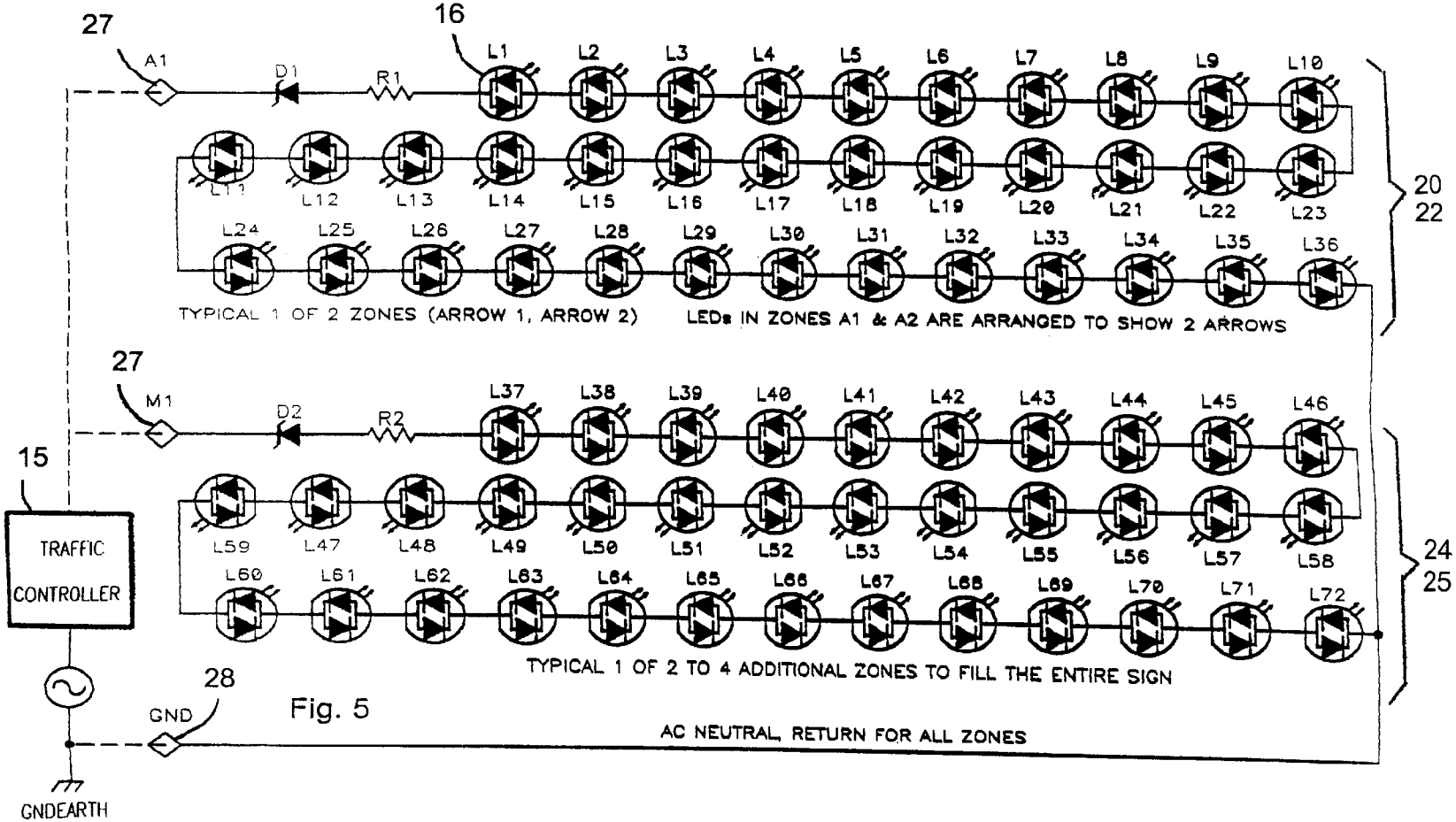
FIG. 5 is a partial circuit diagram showing the display board of FIGS. 3–4.

The apparatus 10 of FIGS. 3–5 may be used as part of a system, including the apparatus and a controller 15 (FIG. 5) to send control signals to each of the zones or patterns making up the display.

As will be further detailed herein, each of the zones or patterns 20, 22, 24, and 25 may be independently powered to emit any one of a number of different colors at a fixed point in time, allowing for the single array 18 to sequentially display a series of different colors. By powering all of the zones or patterns in the array 18 in the same manner and at the same time, a solid color may be displayed. It is an important feature of the apparatus 10 according to the present invention that the signal(s) fed to the display may be modified, with a resulting change in the visual color signal (s) emitted by the apparatus 10.

The apparatus 10 according to the invention uses a single, compact display unit, instead of a stack of separate individual lights, to display each of the standard traffic signal colors. Furthermore, by selectively powering various zones or patterns within the display, as will be further described, the same display apparatus 10 maybe used to display a turning arrow and/or a vertical arrow to indicate through traffic, and each of these arrows may be independently displayed in any of three colors at a given time.

In the illustrated embodiment shown in FIG. 3, a first zone or pattern 20 forms the shape of a vertical arrow pointing upward, while a second zone or pattern 22 forms the shape of a horizontal arrow pointing to the left. It will be understood that the apparatus shown in FIG. 3 may be rotated 90 degrees in a clockwise direction from the orientation shown, and if so rotated, the arrows of the first and second zones or patterns 20, 22 will then be usable as a straight arrow and a horizontal arrow pointing to the right.

A third zone or pattern 24 partially fills the space around the first and second zones or patterns 20, 22, and a fourth zone or pattern 25 fills in the rest of the space around the first and second zones or patterns 20, 22.

One advantage of dividing the display board 12 into multiple, independently powered zones or patterns is that if one of the zones or patterns fails due to a malfunction, the rest of the zones or patterns will still work, leaving the apparatus some ability to display red, yellow or green lights.

The zones or patterns 20, 22, 24, 25 may be operated independently or together in any combination. It will be seen that in the embodiment of FIG. 3, all of the zones or patterns 20, 22, 24, 25 taken together form a substantially diamond-shaped grouping. This diamond-shaped grouping may be varied or modified to provide a different shape, as desired, with additional zones.

It will be understood that the total shape of all of the zones or patterns together may be made circular, or may be made in any other desired shape, depending on how the LEDs are arranged on the circuit board 12. The illustration of the circuit board 12 and array 18 shown in FIG. 3 is intended to illustrate, rather than to limit the invention. Those in the art will realize that other, different groupings of LEDs may be chosen besides the depicted array 18. As one example, words, other indicia, or other symbols may be used as part of the display, as appropriate for a particular application.

All of the zones or patterns 20, 22, 24, 25 may be operated together, to display the standard solid traffic signals of green, yellow and red.

Alternatively, each of the zones or patterns 20, 22, 24, 25 may be independently powered, as desired, to form one or more of a plurality of symbols. Each zone or pattern may be selected to be a specific color at a chosen time. Each zone or pattern may be solid or flashing, as desired.

It is an important feature in the practice of the present invention that at least some of the LEDs used in the display apparatus 10 be bicolor bipolar LEDs, that is, be capable of lighting up in at least two different colors, and preferably in three colors, depending on how power is applied thereto. In the embodiment of FIG. 3, all of the LEDs 16 used in the traffic signaling apparatus 10 are bicolor bipolar LEDs.

The traffic signal display apparatus 10 may further include a three-wire circuit, for interfacing the apparatus 10 with an existing traffic controller, as shown at 30 in FIG. 1. This circuit 30 is intended to be considered together with the circuit of FIG. 5.

The circuit 30 of FIG. 1 includes a fist power input pathway 32 containing a first diode D1, which rectifies the normal sine wave of the supplied power to be exclusively positive. The circuit 30 further includes a second power input pathway 36 containing a second diode D2, which rectifies the normal sine wave of the supplied power to be exclusively negative.

The third pathway 38 does not include any diodes, and therefore will send alternating current through the circuit.

When electricity is fed into the circuit 30 via the first input pathway 32, the bicolor bipolar LEDs 16 (FIG. 5) display a first color, which may be red. When electricity is fed into the circuit 30 via the second input pathway 36, the bicolor bipolar LEDs 16 display a second color, which may be green. When electricity is fed into the circuit 30 via the third input pathway 38, the bicolor bipolar LEDs 16 display a third color, which may be yellow or amber.

The following is a summary of the preferred inputs to operate the basic minimum components for the apparatus 10, shown schematically in FIG. 5:

For Red: Positive rectified 120 volt AC,
either half-wave
or full wave

For Green: Negative rectified 120 volt AC,
either half-wave
or full wave

For Amber: apply 120 volt AC signal directly, with no rectification.

Alternatively, in another preferred embodiment of the invention, for use in new installations, the traffic controller 15 would output one of three types of pulse width modulated (PWM) signal to a selected zone, at any given time.

A positive constant amplitude PWM signal would provide a red visual output from the bicolor bipolar LEDs 16.

A negative constant amplitude PWM signal would provide a green visual output from the bicolor bipolar LEDs 16.

A combination of both positive and negative constant amplitude PWM signals would provide a yellow or amber visual output from the LEDs 16.

This method will provide constant light output from the signal despite changes in the voltage received from local utilities, and would also allow for changing the light output in response to changes in ambient light (i.e. night vs. day) by varying the pulse width of the signal sent to the display 10.

Further, it will be understood that by selectively powering specific zones such as those shown at 20, 22, the same basic display unit 10 may be used to show additional symbols such as arrows. The arrows in zones 20 and 22 may be shown solid or flashing. The arrows in zones 20 and 22 may be shown independently in any of the three colors, as described above.

The schematic circuit diagram of FIG. 5 shows two different zones 20, 24 to illustrate detailed construction of the apparatus 10. Each of the zones 20, 22, 24, 25 has an individual signal input 27, allowing the display to show one arrow, two arrows, or a fully lit display when all zones are activated. The individual inputs 27 can be given the same signal or different signals at any particular time, to provide any of the three available colors.

Each of the different zones 20, 22, 24, 25 is independent of the other zones. A given zone such as 20 may be powered by the controller 15 at a given time, to provide a single arrow, which may be made to change colors in the normal sequence.

Any or all of the zones 20, 22, 24, 25 maybe intermittently powered, so as to present a flashing appearance to an observer.

Therefore, it will be seen that for the circuit illustrated in FIG. 5, one input wire and a common wire will be sufficient to generate the three commonly used colors of a standard traffic light, compared to six or more wires used in a three-light conventional signal.

Two input wires and a common wire will be needed to generate the three conventional light colors plus one arrow, compared to eight or more wires in a four-light conventional signal.

Three input wires and a common wire will be needed to generate the three conventional light colors plus either or both of two arrows, compared to ten or more wires in a five-light conventional signal.

The maximum power consumption for the apparatus 10 of FIGS. 3–5 is 18 watts, which is a significant improvement over conventional signal lights.

The apparatus 10 may include circuitry to provide current regulation or limiting, to minimize changes in light intensity caused by variations in the power supply.

The apparatus 10 may include a thermistor to adjust current in relation to ambient temperature, in order to compensate for variations in LED light intensity, caused by temperature fluctuations.

The apparatus 10 may further include an ambient light sensor and related circuitry to adjust the intensity of the light generated by the LEDs 16, in relation to the ambient light.

Figure 6:
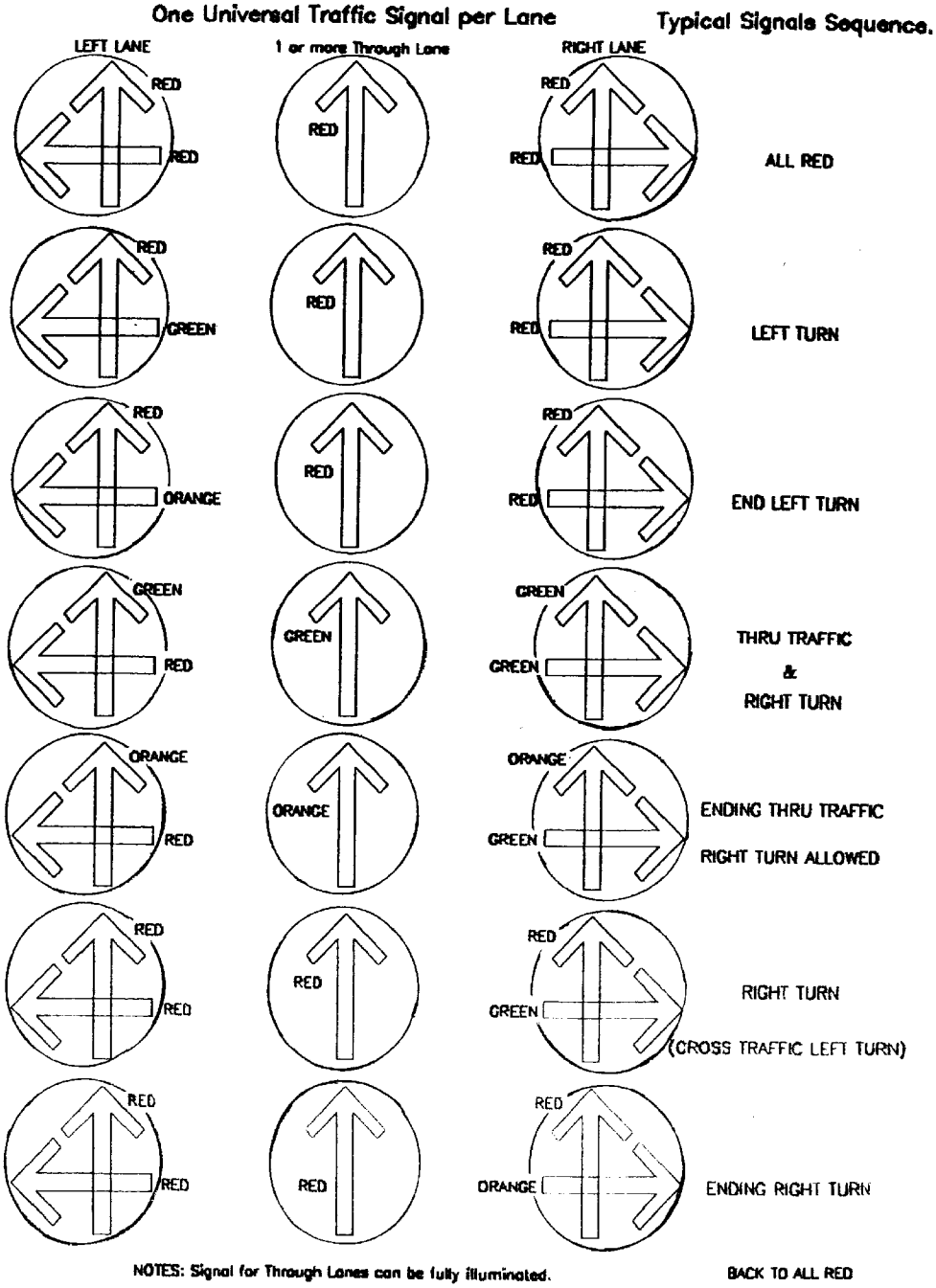
FIG. 6 is a series of color illustrations showing some of the displays that can be generated using the apparatus of FIG. 3.

The illustrations of FIG. 6 demonstrate some of the combinations of signals which can be produced using the apparatus of FIG. 3, by controlling the input to the different zones 20, 22, 24 and 25.

Pedestrian Crossing Sign

Figure 7:
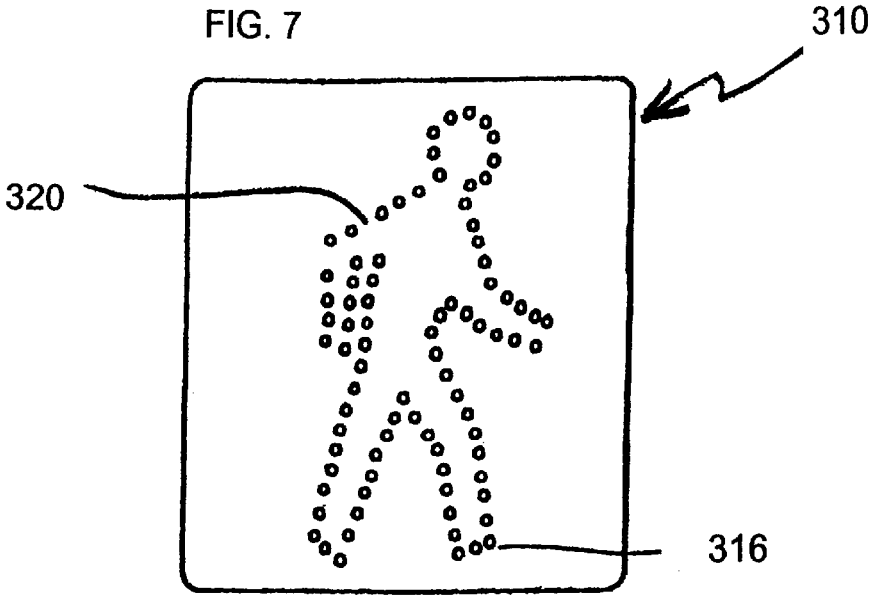
FIG. 7 is a front plan view of a display board in accordance with a second embodiment of the invention, powered to display a first symbol in any of three colors.
Figure 8:
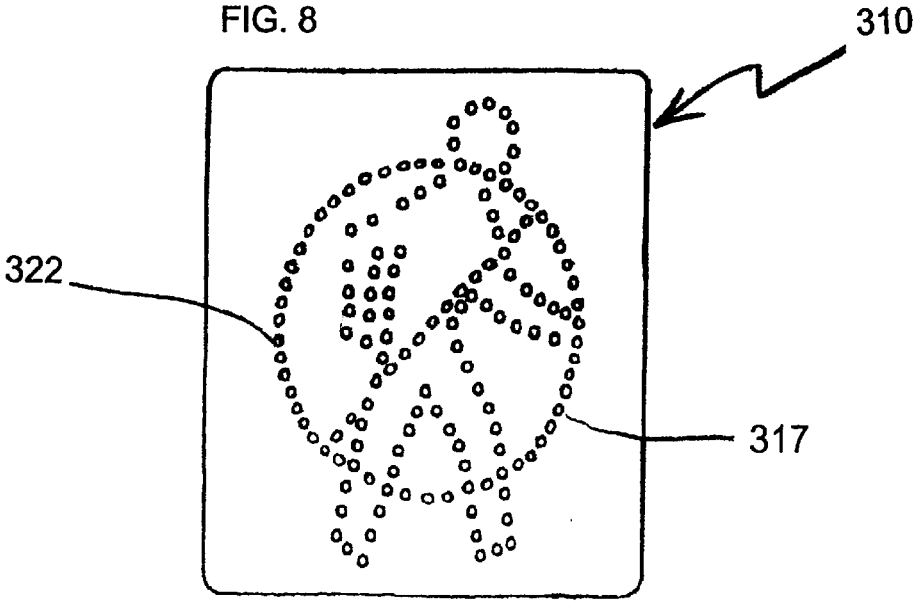
FIG. 8 is a front plan view of the display board of FIG. 7, powered to display a second symbol which is a modified form of the first symbol.

Referring now to FIGS. 7–8, it will be seen that bicolor bipolar LEDs 316 may be arranged in cooperation with single color LEDs 317, in two zones or patterns, to form a walk/don't walk signal apparatus 310 in accordance with a second embodiment of the present invention. A first zone or pattern 320 may be formed in the shape of selected indicia. The selected indicia may be a first symbol such as an outline shape of a walking pedestrian, as shown in FIG. 7. This zone or pattern 320 is made up of bicolor bipolar LEDs 316, and may be illuminated, at a first time, by passing negative rectified 120 volt AC therethrough, to light the bicolor bipolar LEDs thereof in a first color, which may be green.

After a first amount of time has elapsed, the first zone or pattern 320 (the pedestrian) may be illuminated in a second color, such as amber, by passing a 120 volt AC signal directly, with no rectification therethrough. The display may also be made to flash intermittently, if desired, by the controller 15 interrupting the flow of power to the LEDs 316, as a warning.

Then, after a second amount of time has elapsed, the first zone or pattern 320 (the pedestrian) may be illuminated in a third color, which may be red, by passing positive rectified 120 volt AC therethrough. At the same time, a plurality of red single-color LEDs 317 in a second zone or pattern 322 may be conventionally powered to form a second symbol overlaying the first symbol. The second symbol may be the international symbol for 'do not', as shown in FIG. 8, thereby generating a "DON'T WALK" signal.

Tis combined display, as shown in FIG. 8 and in the color(s) red and/or orange, can be used to signal pedestrians to refrain from crossing until the signal changes.

As an alternative approach to that discussed above, bicolor bipolar LEDs may also be used for the zone or pattern 322 of the second symbol, but may only be activated to show red during the third phase of the display.

Although the present invention has been described herein with respect to specific preferred embodiments thereof, the foregoing description is intended to be illustrative, and not restrictive. Those skilled in the art will realize that many modifications of the preferred embodiment could be made which would be operable. All such modifications which fall within the basic concept of the invention as described herein, and which use bicolor bipolar LEDs to generate a color-changing display in a traffic signaling apparatus, are intended to be included within the scope of the invention.

I claim:

1. A traffic signal display apparatus, comprising:

a substrate having a display surface;

a plurality of bicolor bipolar LEDs operatively associated with said display surface and cooperating to define an array; and a circuit for use in cooperation with a power source to selectively power said array;

wherein said array is constructed and arranged to selectively display any one of a plurality of different visual color signals, depending on the power supplied thereto.

2. The traffic signal display apparatus of claim 1, wherein the display surface comprises a plurality of zones, each of the zones is powered as a unit, allowing any of said zones to be selectively powered differently from any other of said zones.

3. The traffic signal display apparatus of claim 1, wherein said apparatus is operable to display various flashing signals to help color blind motorists.

4. The traffic signal display apparatus of claim 1, further comprising a plurality of single color LEDs operatively associated with said display surface.

5. The traffic signal display apparatus of claim 2, wherein selected zones of the bicolor bipolar LEDs generate a red color in response to power being fed therethrough in a first direction, wherein the selected bicolor bipolar LEDs generate a green color in response to current being fed therethrough in a second direction, and wherein the selected bicolor bipolar LEDs generate a yellow color in response to power being fed therethrough alternately in both the first and second directions.

6. The traffic signal display apparatus of claim 2, wherein at least one of said zones is formed in an arrow shape.

7. The apparatus of claim 2, wherein the LEDs within each zone are connected to one another in series.

8. A method of controlling a traffic signal generating apparatus containing a plurality of bicolor bipolar LEDs arranged to form an array therein, said method comprising the steps of:

a) sending negative rectified current through a selected number of said bicolor bipolar LEDs to generate a green color signal for a measured time increment;

b) sending unrectified current through said selected bicolor bipolar LEDs to generate a yellow color signal for a second time increment subsequent to the first increment; and c) sending positive rectified current through said selected bicolor bipolar LEDs to generate a red color signal for a third time increment subsequent to the second increment.

9. The method of claim 8, wherein said array contains multiple zones, and wherein some of the zones can be powered to display symbols in any of the three colors.

10. A traffic signal display apparatus, comprising:

a support substrate having a display surface;

a plurality of bicolor bipolar LEDs operatively associated with said display surface and cooperating to define an array representing symbolic indicia, said array containing a plurality of zones; and a circuit for use in cooperation with a power source to selectively power selected zones;

wherein the array is adapted to selectively display any one of a plurality of different visual color symbols.

11. The traffic signal display apparatus of claim 10, wherein the array includes a first symbol and a second symbol.

12. A traffic signal display apparatus, comprising:

a support substrate having a display surface;

a plurality of bicolor bipolar LEDs operatively associated with said display surface and cooperating to define an array, said array including a plurality of defined zones, each of said zones being independently operable to selectively display one of a plurality of colors, depending on the power supplied thereto, the LEDs within each zone being connected to one another in series; and a circuit for use in cooperation with a power source to selectively power selected ones of said zones.

13. The traffic signal display apparatus of claim 12, wherein a first of said zones is formed in an arrow shape.

14. The traffic signal display apparatus of claim 13, wherein a second of said zones is formed in an arrow shape, which is perpendicular to the arrow shape of said first zone.

15. The traffic signal display apparatus of claim 14, wherein said apparatus can be oriented one way for use in right lane installations, and can be oriented another way for use in all other lanes.

16. A traffic signal display apparatus, comprising:

a support substrate having a display surface;

a plurality of bicolor bipolar LEDs operatively associated with said display surface and cooperating to define an array, said array including a plurality of defined zones, at least one of said zones being formed in an arrow shape;

said zones being operable to selectively display any one of a plurality of traffic signals including solid red, solid yellow, solid green or a directional arrow in any of the three colors at a given time.

17. The traffic signal display apparatus of claim 16, wherein any of said traffic signals may be displayed either solid or flashing.

* * * * *